United States Patent [19]

Tanizaki et al.

[11] 4,152,872

[45] May 8, 1979

[54] SLIDING MECHANISM FOR VEHICLE SLIDING DOOR

[75] Inventors: Hiroyuki Tanizaki, Yokohama; Michio Shinada, Nagoya, both of Japan

[73] Assignee: Nissan Motor Company, Limited, Yokohama, Japan

[21] Appl. No.: 868,295

[22] Filed: Jan. 10, 1978

[30] Foreign Application Priority Data

Jan. 12, 1977 [JP] Japan ..... 52-2046

[51] Int. Cl.[2] ..... E05D 15/10

[52] U.S. Cl. ..... 49/214; 49/215; 49/223; 16/96 R; 16/97; 16/98

[58] Field of Search ..... 49/213, 214, 215, 223, 49/225, 221, 209, 409, 410; 16/87.6 R, 87.8, 87 R, 97, 98, 96 R

[56] References Cited

U.S. PATENT DOCUMENTS

| | | | |
|---|---|---|---|
| 3,587,477 | 12/1968 | Ferris | 49/410 |

FOREIGN PATENT DOCUMENTS

| | | | |
|---|---|---|---|
| 2022487 | 5/1970 | Fed. Rep. of Germany | 49/214 |
| 1409821 | 7/1965 | France | 16/97 |
| 882723 | 11/1961 | United Kingdom | 49/214 |
| 956620 | 4/1964 | United Kingdom | 49/225 |
| 1125871 | 9/1968 | United Kingdom | 49/209 |

*Primary Examiner*—Kenneth Downey

[57] ABSTRACT

An elongate guide track having at least one elongate ridge portion is fixed to a side wall of a vehicle in such a manner that the ridge portion extends substantially horizontally and projects upwardly. A vertical roller and at least one horizontal roller are rotatably connected to an end of the door through a pivotable bracket member. The vertical roller is formed at its peripheral wall with an annular groove so as to slidably receive therein the elongate ridge portion.

9 Claims, 17 Drawing Figures

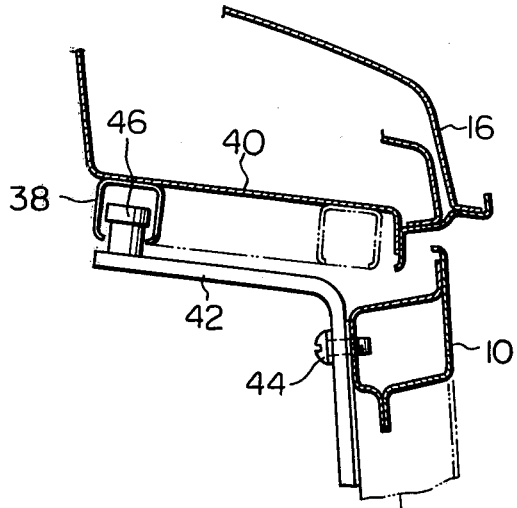
Fig. 4
PRIOR ART
Fig. 5 PRIOR ART
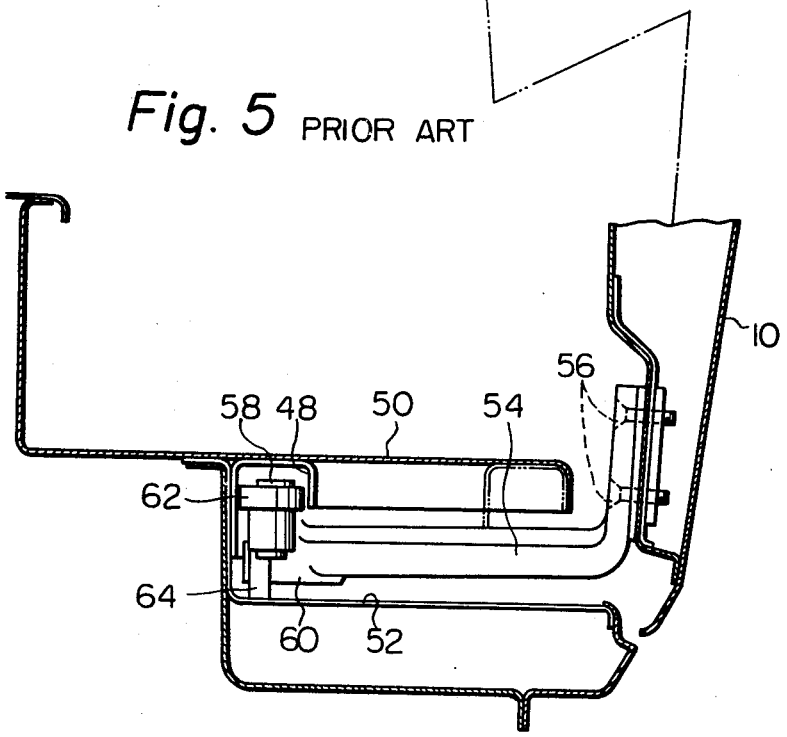

Fig. 15
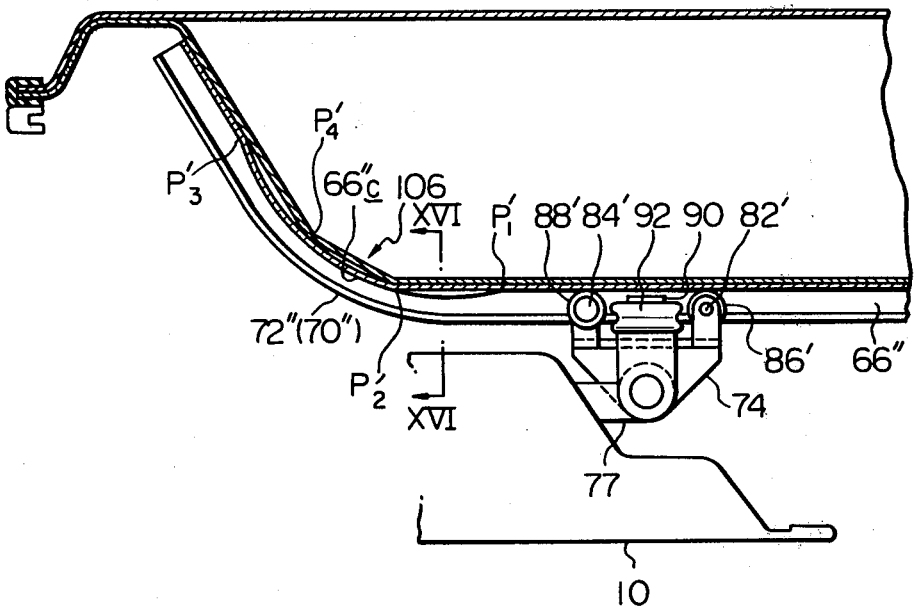
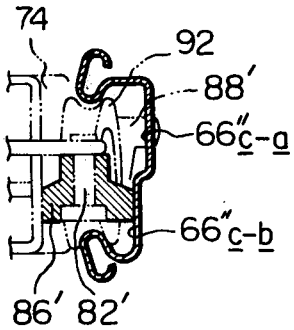
Fig. 16

SLIDING MECHANISM FOR VEHICLE SLIDING DOOR

The present invention relates in general to a sliding door installation in a motor vehicle and more particularly to a sliding mechanism of the installation.

Throughout the specification, the terms "forward" and "rearward" are to be understood as referring to "in the direction of the front of a vehicle to which a sliding door is equipped" and "in the direction of the rear of the vehicle to which the sliding door is equipped," respectively, and "vertical" and "horizontal" to be taken as vertical and horizontal with respect to the vehicle chassis.

It is an object of the present invention to provide an improved sliding mechanism which assures smooth and reliable movements of sliding door of a vehicle.

It is another object of the present invention to provide an improved sliding mechanism which does not interfere the body styling of the vehicle nor mar the appearance of the same.

It is still another object of the present invention to provide a sliding mechanism which is simple in construction and thus suitable for mass production.

Other objects and advantages of the present invention will become apparent from the following detailed description when taken in conjunction with the accompanying drawings, in which:

FIGS. 4 and 5 are enlarged, vertically sectional views of two portions which are respectively enclosed by circles B and C in FIG. 1;

FIG. 15 is a view similar to FIG. 6, but shows a sixth preferred embodiment of the present invention;

FIG. 16 is a sectional view taken along the line XVI—XVI of FIG. 15; and

Prior to describing the construction of the sliding mechanism of the sliding door installation according to the present invention, explanation of a conventional sliding mechanism will be made with the aid of FIGS. 1 to 5 in order to clarify the inventive steps of the invention.

Figure 1:
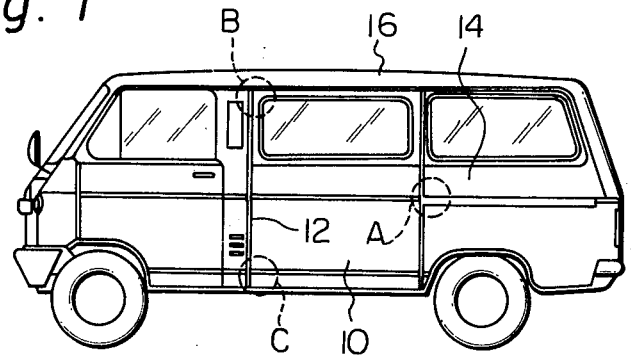
FIG. 1 is a side elevation view of a van type vehicle equipped with a conventional sliding door.

In FIG. 1, a van type vehicle is illustrated as having a sliding door 10 received in an opening 12 formed in a side wall or panel 14 of the vehicle body 16. The door 10 is constructed to slidably move from the illustrated closed position to an open position where the door 10 is located rearward or aft of the opening 12. The sliding mechanism employed in the above-mentioned vehicle is clearly shown in FIGS. 2 to 5.

Figure 2:
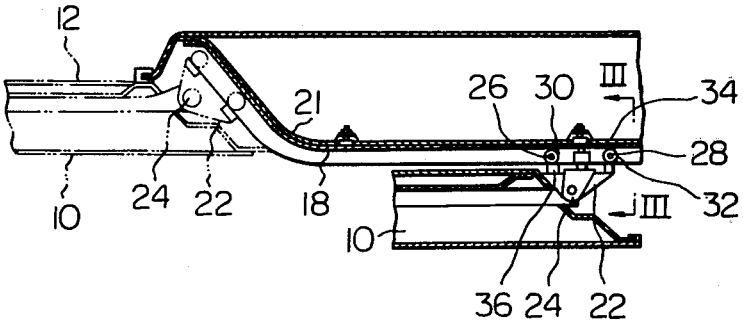
Fig. 2 PRIOR ART
FIG. 2 is an enlarged, horizontally sectional view of a portion enclosed by a circle A in FIG. 1.
Figure 3:
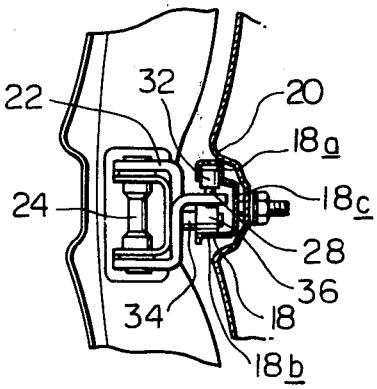
Fig. 3 PRIOR ART
FIG. 3 is a sectional view taken along the line III—III of FIG. 2.

Referring to FIGS. 2 and 3, there is shown a first section of the sliding mechanism which provides connection between the door and the side wall at and along the mid level portions thereof. The first section of the mechanism comprises an elongate track or rail 18 which is received in a groove 20 formed along the middle portion of the side wall 14 and which is parallel with the longitudinal axis of the vehicle. For providing tight connection therebetween, conventional nuts and bolts (no numerals) are used. As is seen from FIG. 3, the guide track 18 is formed as a channel member having upper and lower side wall sections **18*a* and 18*b* and a base wall section 18*c*, the base wall section 18*c* being directly attached via bolts to the inboard surface of the horizontal groove 20. The lower side wall section 18*b* is substantially flat, while the upper side wall section 18*a* is formed with a channel extending through the longitudinal length thereof in a manner that an open portion of the channel faces the lower side wall section 18*b*, as shown. As is well seen from FIG. 2, the guide track 18 is smoothly curved at a portion 21 near a rear edge of the opening 12** toward the interior of the vehicle.

The first section further comprises a generally U-shaped roller supporter 22 which is swingably or pivotably connected via an upright pivot member or pin 24 to a portion of the door 10 rearward of the middle thereof so as to be horizontally swingable about the pivot member 24. The U-shaped roller supporter 22 is provided with a pair of spaced laterally extending arms (no numerals) to which two vertical shafts 26 and 28 are respectively fixed to mount thereon two horizontal rollers 30 and 32. Extending from the roller supporter 22 in the same direction as the above-mentioned arms is a horizontal shaft 34 on which a vertical roller 36 is rotatably disposed. In the drawing, the vertical roller 36 is shown to be larger than the horizontal rollers 30 and 32, and the shaft 34 is shown to be located between the two arms.

As is easily understood from the drawings, in assembly, the two horizontal rollers 30 and 32 are loosely received in the channel of the upper side wall section **18*a* and the vertical roller 36 rolls on the lower side wall section 18*b* of the guide track 18 so that these rollers run along the guide track 18 upon forward and rearward movements of the door 10**.

Referring to FIG. 4, there is illustrated a second section of the sliding mechanism, which is arranged at the top and an upper sill 40 of the sliding door 10 and the side opening 12. The second section comprises a guide track 38 which is firmly connected to the upper sill 40 of the body 16, and which defines the upper section of the side opening 12. As is seen from the drawing, the guide track 38 is of an elongate channel member and is so arranged that the open portion thereof faces downward. Although not well shown in the drawing, the front end portion of the guide track 38 is smoothly curved or bent toward the inside of the vehicle.

The second section further includes a generally L-shaped arm member or bracket 42 which is fixed via bolts 44 to a foreward-upper section of the door 10 so that the leading free end thereof extends toward the inside of the vehicle. The leading free end of the arm member 42 is equipped with an upright shaft (not shown) about which a roller 46 is rotatably disposed. In assemblage of the door 10 with the side wall 14 of the vehicle, the roller 46 is received in the guide track 38 such that the foreward-upper section of the door 10 is guided by the track 38 during the opening and closing movements of the door 10.

Referring to FIG. 5, there is shown a third section of the sliding mechanism, which is arranged at the bottom of the sliding door 10 and corresponding portion of the opening 12. The third section comprises a guide track 48 which is firmly connected to an inboard portion of a lower sill 50 defining a lower section of the opening 12. Similar to the above-mentioned guide track 38 fixed to the upper sill 40, the guide track 48 is formed into a channel member and is arranged so that the open portion thereof faces downward, as shown. Also in this guide track 48, the front end portion is smoothly curved or bent toward the inside of the vehicle, although not well shown. A guide track 52 having a generally L-shaped cross section is fixed to a lower portion of the side opening 12 to provide a relatively wide flat surface facing the guide track 48.

The third section further comprises a generally L-shaped arm member or bracket 54 which is fixed at its one end via bolts 56 to a front-lower section of the door 10 so that the leading free end thereof extends toward the inside of the vehicle. The leading end is provided or formed with vertical and horizontal shafts 58 and 60 about which respective rollers 62 and 64 are rotatably disposed. As shown, the roller 62 is received in the guide track 48 while the roller 64 is arranged to roll on the flat surface of the wide guide track 52 in assemblage of the door 10 with the body of the vehicle so that the foreward-lower section of the door 10 is guided or supported by the tracks 48 and 52 during the sliding movements of the door 10.

With the above-stated construction of the conventional sliding mechanism, especially of the construction of the first section, located at substantially the vertically mid level portions of the door 10 and the side wall 14, there will arise the following drawbacks and demerits:

(1) The provision of the channel in the upper side wall section 18*a* of the first section of the guide track 18 causes the guide track to have an unduly wide construction in the vertical direction and thus interferes with and mars the appearance of the vehicle. This effect can be partially solved by providing a smaller channel in the upper side wall section and using suitably small rollers therein. However, this arrangement suffers from the drawback that the rollers undergo high speed rotation during opening and closing of the door 10 which results in rapid wearing of the same.

(2) Since the paths respectively swept out by each of the horizontal rollers 30 and 32 and the vertical roller 36 under movements thereof along the curved section of the guide track 18 are not identical to each other, the vertical roller 36 is subjected to sideway slippage against the lower side wall section 18*b* of the guide track 18. Such slippage causes marked abrasion of the roller 36 inducing ill-balanced rotation of the same.

Accordingly, the present invention contemplates to eliminate the drawbacks mentioned above. More specifically, the present invention contemplates to provide an improved sliding mechanism which is arranged on the vertically middle portions of the sliding door 10 and the side wall 14 as a substitute for the before-mentioned first section.

Figure 6:
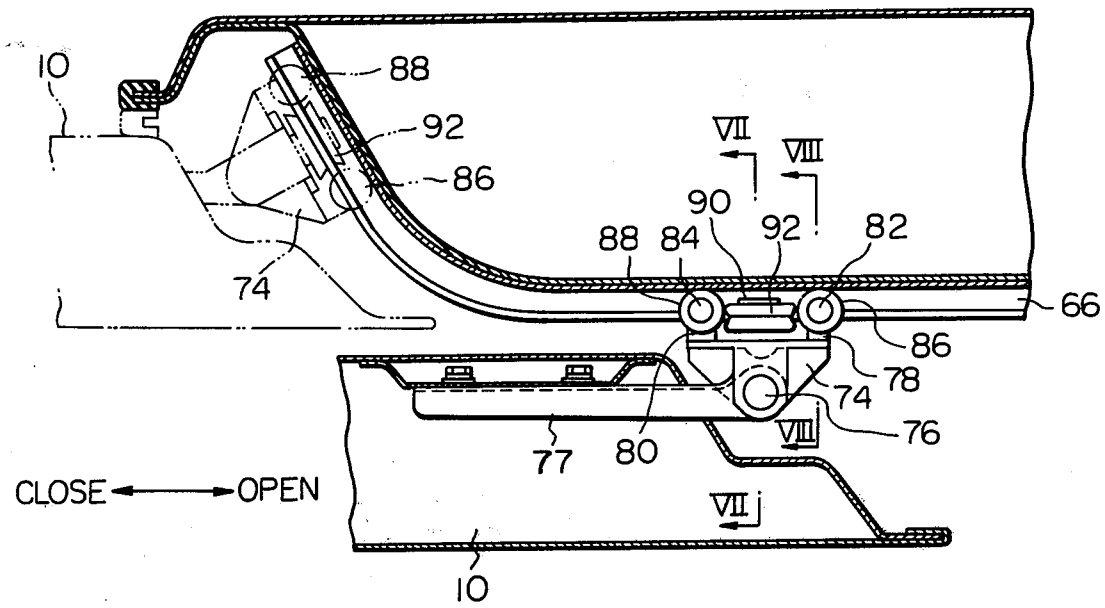
FIG. 6 is a view similar to FIG. 2, but shows a first preferred embodiment of the present invention.
Figure 7:
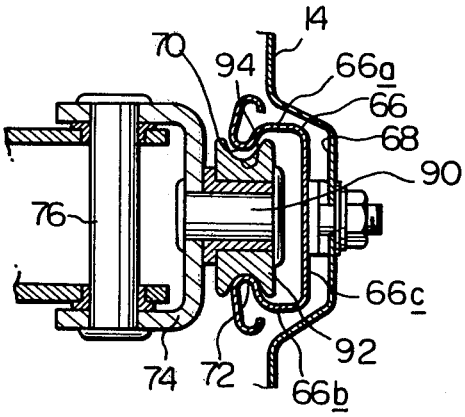
FIG. 7 is a sectional view taken along the line VII—VII of FIG. 6.
Figure 8:
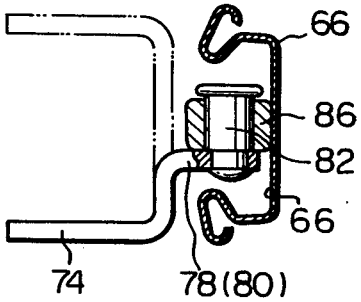
FIG. 8 is a sectional view taken along the line VIII—VIII of FIG. 6.

Referring to FIGS. 6 to 8, especially to FIG. 6, there is illustrated a first preferred embodiment of the sliding mechanism according to the subject invention. The mechanism shown comprises an elongate guide track 66 which is held through conventional fastening means (no numeral) in a substantially horizontal groove 68 formed in the vertically middle portion of the side wall 14. As is best seen in FIG. 7, the guide track 66 is formed to have a substantially C-shaped cross section having upper and lower side wall sections 66*a* and 66*b* and a flat base wall section 66*c*, the base wall section 66*c* being directly attached via conventional means such as fastening bolts to the bottom of the horizontal groove 68. The upper and lower side wall sections 66*a* and 66*b* are respectively formed with longitudinally extending ridges 70 and 72 which project toward each other, as shown. As is seen from FIG. 6, the guide track 66 is smoothly curved or bent at a portion near the rear edge of the opening 12 toward the interior of the vehicle, furthermore, the ridges 70 and 72 are formed to extend parallel to the base wall section 66*c*.

The sliding mechanism of the first embodiment further includes a generally U-shaped roller supporter 74 which is swingably or pivotably connected via an upright hinge pin or pivot member 76 to a rear portion of a bracket 77 firmly fixed to a rear and vertically middle portion of the door 10. As is shown in FIG. 8, the roller supporter 74 is formed with a pair of laterally extending spaced arms 78 and 80 to which two vertical shafts 82 and 84 are respectively fixed to mount thereon two horizontal rollers 86 and 88, the rollers 86 and 88 being freely rotatable about their corresponding shafts 82 and 84. As is best seen in FIG. 6, a horizontal shaft 90 is fixed to the roller supporter 74 between the two arms 78 and 80. Rotatably disposed about the shaft 90 is a vertical roller 92 which is formed around the peripheral portion thereof with an annular groove 94, as well shown in FIG. 7.

In assemblage, the vertical roller 92 is engaged via the groove 94 thereof with the ridges 70 and 72 of the guide track 66 and the two horizontal rollers 86 and 88 are engaged at their cylindrical outer surfaces with the base wall section 66*c* of the guide track 66, so that these rollers run along the guide track 66 during the forward and rearward movements of the door 10.

With the provision of the ridges 70 and 72 of the guide track 66 and the corresponding annular groove 94 formed in the vertical roller 92, the assembly of the roller supporter 74 and the rollers 92, 86 and 88 is securely forced to follow a predetermined trace whereby the vertical roller 92 is prevented from deviation from the trace. More specifically, the moments of force produced about the hinge pin 76 upon the sliding movements of the door 10 are received via the assembly of the roller supporter 74 and the rollers 86, 88 and 92 by not only the base wall section 66*c* but also the ridges 70 and 72. Thus, the sliding movements of the door 10 are carried out in a stable and reliable manner even when running along the inwardly curved section of the guide track 66.

Although in the previous description, the two horizontal rollers 86 and 88 have been shown to engage with the base wall section 66c of the guide track 66, it is also possible to allow the rollers 86 and 88 to engage with the side wall 14 other than the horizontal groove 68 by employing two elongate vertical shafts (not shown).

Figure 9:
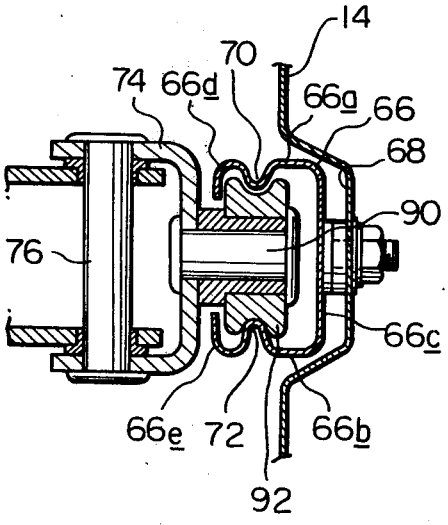
FIG. 9 is a view similar to FIG. 7, but shows a portion of a second preferred embodiment of the present invention.

Referring to FIG. 9, there is shown a second preferred embodiment of the invention, which comprises substantially the same parts as in the case of the aforementioned first embodiment except that the upper and lower side wall sections 66a and 66b are formed with flange portions 66d and 66e which extend toward each other. With this, the vertical roller 92 is assuredly prevented from derailment from the ridges 70 and 72 of the guide track 66 even when marked abrasion of the vertical roller 92 occurs. Of course, the width of the clearance defined by the two flange portions 66d and 66e is arranged to be smaller than the diameter of the vertical roller 92.

Figure 10:
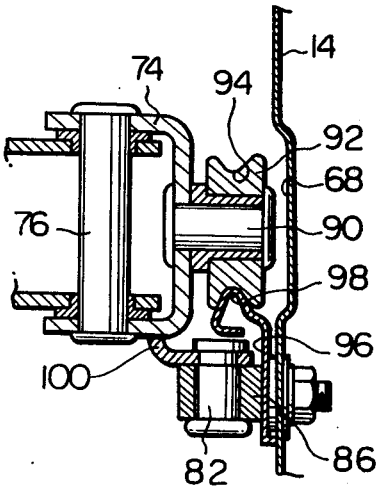
FIG. 10 is a view also similar to FIG. 7, but shows a portion of a third preferred embodiment of the present invention.

Referring to FIG. 10, a third preferred embodiment of the sliding mechanism is shown, which can be made relatively compact. The mechanism of this embodiment comprises an elongate guide track 96 having a generally L-shaped cross section. The guide track 96 is fixed at its one section to the side wall 14 of the vehicle body at a portion below the horizontal groove 68 so that an upwardly projecting elongate ridge 98 formed on the other section of the track 96 is received in or engaged with the annular groove 94 of the vertical roller 92 to support the roller 92. The two horizontal rollers 86 and 88 are arranged to contact with a flat surface of the one section of the track 96 via a pair of arms 100 which laterally extend from lower sections of the roller supporter 74.

Figure 11:
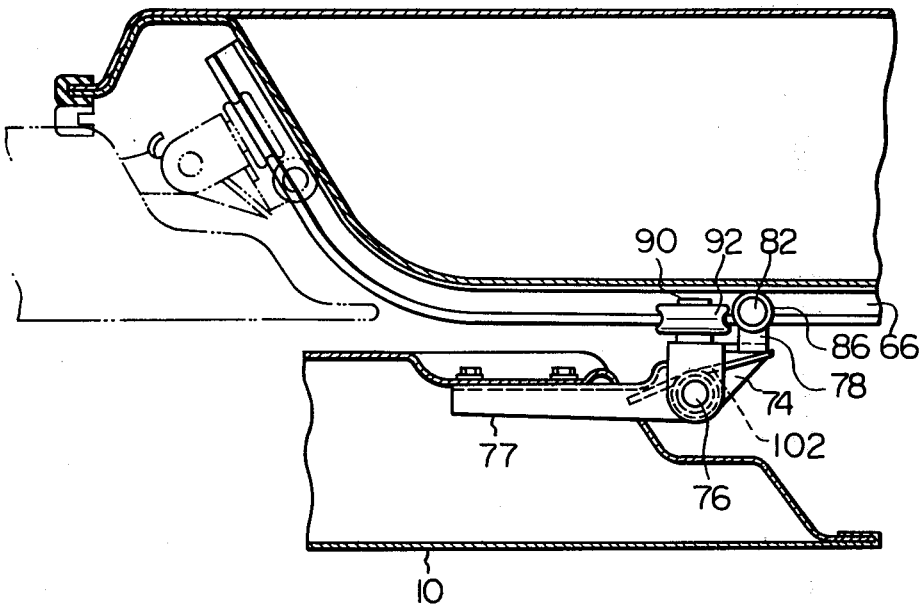
FIG. 11 is a view similar to FIG. 6, but shows a fourth preferred embodiment of the present invention.

Referring to FIG. 11, there is shown a fourth preferred embodiment of the sliding mechanism of the invention. This embodiment achieves compactness and simplification of the mechanism by using only one horizontal roller. As shown, the mechanism of this embodiment includes only one horizontal roller 86 which is rotatably disposed on a vertical shaft 82 fixed to an arm 78, the arm 78 extending from the swingable roller supporter 74. A spring 102 is disposed about the vertical hinge pin 76, extending its terminal ends to engage with the bracket 77 of the door 10 and the roller supporter 74 so as to bias the roller supporter 74 to swing in a direction to press the roller 86 against the base wall section 66c of the guide track 66. Now, it should be noted that the biasing force of the spring 102 is selected to be considerably greater than the moment of force which is produced about the hinge pin 76 when the door 10 is moved into its closing position, that is in a leftward direction in the drawing.

With this construction of the fourth preferred sliding mechanism, the running of the horizontal rollers 82 and the vertical roller 92 on their corresponding base wall section 66c and ridges 70 and 72 is smoothly and assuredly achieved without vibration.

The following description is directed to the other two preferred embodiments, i.e., the fifth and sixth embodiments, which can solve a slight drawback encountered in the first preferred embodiment of FIGS. 6 to 8.

Figure 12:
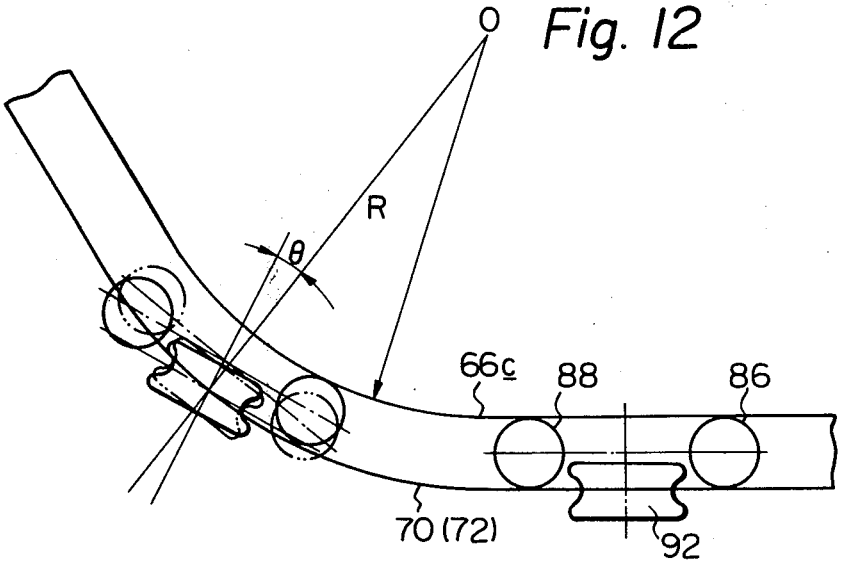
FIG. 12 is a diagrammatic illustration for explaining the positional deviation between rollers connected to the door and their corresponding guide tracks fixed to the side wall of the vehicle of the first preferred embodiment shown in FIG. 6.

Prior to describing the other two emobodiments, explanation about the drawback of the first embodiment will be made with an aid of FIG. 12 which schematically shows the positional relationship between the assembly of the two horizontal rollers 86 and 88 and the vertical roller 92, and the corresponding base wall section 66c and the ridges 70 and 72 of the guide track 66. In this drawing, the reference "O" indicates the common center of two circles which respectively serve the traces constituting the curved portions of the base wall section 66c and each of the ridges 70 or 72. With this construction of the first embodiment, it will inevitably occur that one of the horizontal rollers 86 and 88, more specifically, the horizontal roller positioned at the rear of the vertical roller 92 with respect to the direction of travel of the door 10 is disengaged from the base wall section 66c during the movement of the door 10 along the curved portion of the guide track 66, as will be well understood from the phantom lines illustrated in the drawing. This induces an inclination of "$\theta$" of the assembly of the rollers 86, 88 and 92 with respect to the radial line "R" passing through the center of the vertical roller 92. Thus, in production of the vertical roller 92, the annular groove 94 has to be made wide enough to compensate the above-mentioned undesirable phenomenon.

Figure 13:
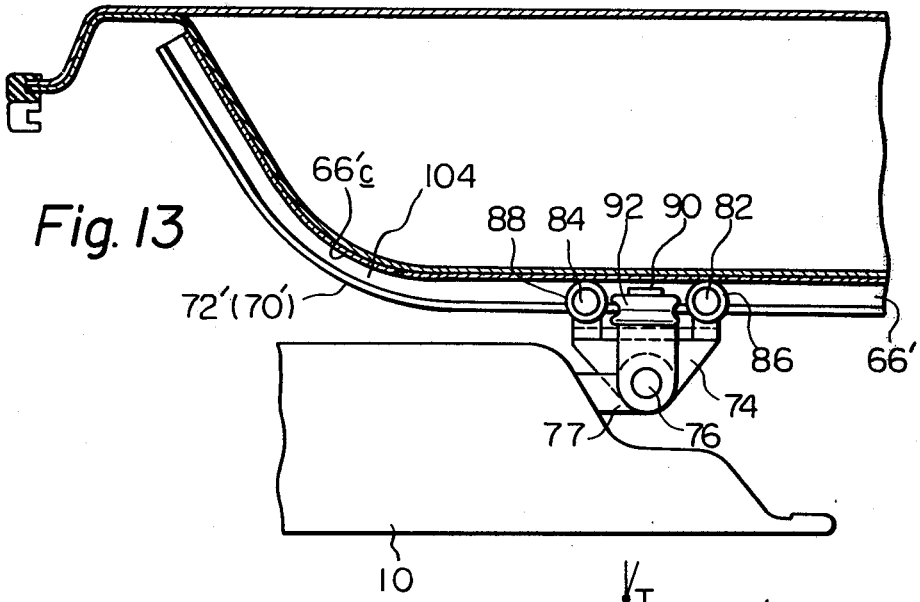
FIG. 13 is a view similar to FIG. 6, but shows a fifth preferred embodiment of the invention.

FIG. 13 shows the fifth embodiment of the invention, which can adequately solve the above-mentioned drawback encountered in the first embodiment. The improvement takes in the form of the guide track 6', more specifically in a curved portion 104 of the track 66'. As will be well understood from the following, the improvement is achieved by forming the curved portion of the base wall section 66'c into a circular arc whose radius is "R" and simultaneously forming each of the curved portions of the ridges 70' and 72' into a complex curve which consists of circular arcs with respective radii of "$R_1$", "$R_2$" and "$R_3$".

Figure 14:
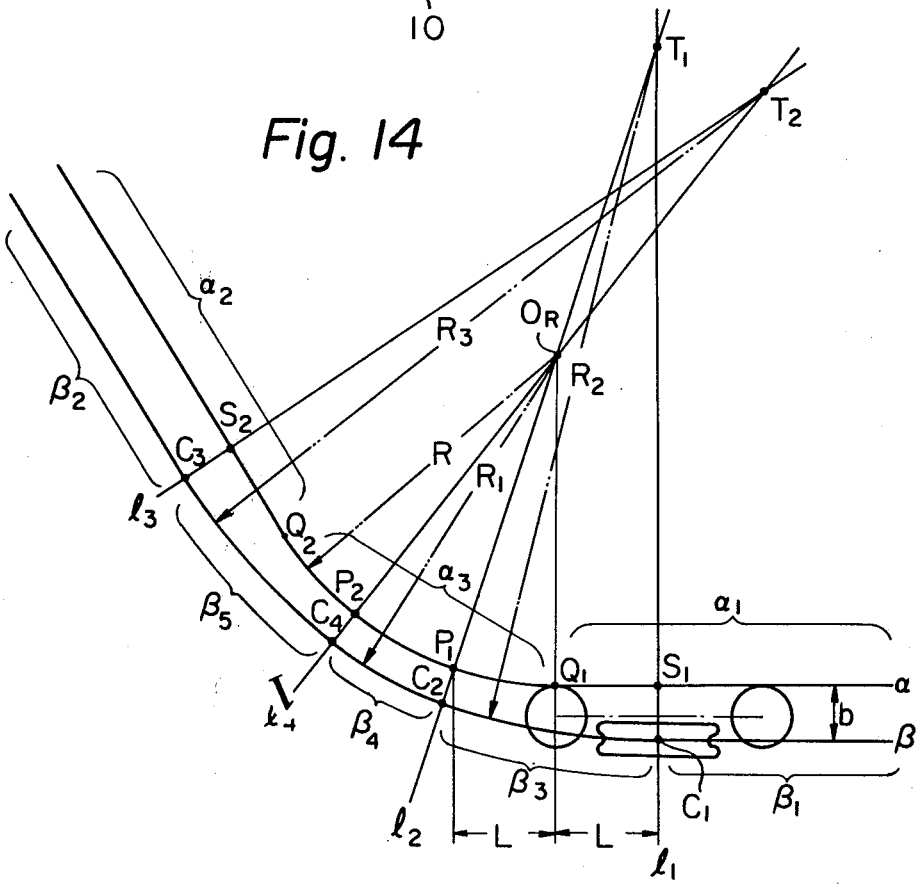
FIG. 14 is a diagrammatic illustration for explaining the method of determining the geometry of the guide track illustrated in FIG. 13.

FIG. 14 is a diagrammatic illustration showing the method of determining the above-mentioned curved portion in the guide track 66'. In this drawing, the references "$\alpha$" and "$\beta$" denote respective lines which are defined by the base wall section 66'c and each ridge 72' (or 70') of the guide track 66'. Further, the references "b" and "L" respectively denote the distance between the straight portion of the base wall section 66'c and the ridge 72' or 70' and the half of the distance between respective shafts 82 and 84 of the two horizontal rollers 86 and 88. The line "$\alpha$" is formed to consist of two straight sections "$\alpha_1$" and "$\alpha_2$" and a circular arc section "$\alpha_3$" of a radius "R", the center of the arc section "$\alpha_3$" being denoted by the reference "$O_R$". The line "$\beta$" is formed to consist of two straight sections "$\beta_1$" and "$\beta_2$", a circular arc section "$\beta_3$" of a radius "$R_2$", a circular arc section "$\beta_4$" of a radius "$R_1$" and a circular arc section "$\beta_5$" of a radius "$R_3$", as shown.

The line "$\beta$" is determined by the following method;

1. Marking the point where the sections "$\alpha_1$" and "$\alpha_2$" intersect, with "$Q_1$", and marking the points which are spaced from the point "$Q_1$" on the line "$\alpha$" by the distance "L" in either directions as shown, with "$S_1$" and "$P_1$".
2. Drawing from the points "$S_1$" and "$P_1$" long lines "$l_1$" and "$l_2$" respectively and marking the point where the lines intersect with each other with "$T_1$".
3. Marking the point on the line "$l_1$" spaced outwardly apart from the point "$S_1$" by the distance "b", with "$C_1$".

4. Drawing a straight line "$\beta_1$" from the point "$C_1$" in the right direction so as to be parallel with the straight line "$\alpha_1$".

5. Drawing an arc "$\beta_3$" from the point "$C_1$" so that the arc is a part of a circle having the center at the point "$T_1$", and marking the point where the arc "$\beta_3$" and the aforementioned line "$l_2$" intersect with each other, with "$C_2$". ("$R_2$" represents the radius of the circle with the center "$T_1$".)

6. Marking the point where the sections "$\alpha_2$" and "$\alpha_3$" intersect with "$Q_2$", and marking the points which are spaced apart from the point "$Q_2$" on the line "$\alpha$" by the distance "L" in either direction as shown, with "$S_2$" and "$P_2$".

7. Drawing from the points "$S_2$" and "$P_2$" long lines "$l_3$" and "$l_4$" respectively and marking the point where the lines intersect with each other with "$T_2$".

8. Marking the point on the line "$l_3$" spaced outwardly apart from the point "$S_2$" by the distance "b", with "$C_3$".

9. Drawing a straight line "$\beta_2$" from the point "$C_3$" in the left direction so as to be parallel with the straight line "$\alpha_2$".

10. Drawing an arc "$\beta_5$" from the point "$C_3$" so that the arc becomes a part of a circle having the center at the point "$T_2$", and marking the point where the arc "$\beta_5$" and the aforementioned line "$l_4$" intersect with each other, with "$C_4$". ("$R_3$" represents the radius of the circle with the center "$T_2$".) It should be noted that the radii "$R_3$" and "$R_3$" defined by the arcs "$\beta_5$" and "$\beta_3$" are the same.

11. Drawing an arc "$\beta_4$" from the point "$C_2$" to the point "$C_4$" so that the arc "$\beta_4$" becomes a part of a circle having the center at the point "$O_R$". ("$R_1$" represents the radius forming the arc "$\beta_4$".)

Now it should be noted that the following equations hold for "R", "$R_1$", "$R_2$", "$R_3$", "L" and "b" if the radius of each horizontal roller 86 or 88 is assumed to be zero.

$$R_1=\sqrt{R^2-L^2+b} \quad (1)$$

$$R_2=R_3=R+\sqrt{R^2-{}^2+B}=R+R_1 \quad (2)$$

With the curved portion in the guide track 66' determined by the above-mentioned method, the before-mentioned drawback regarding the inclination of the roller assembly is eliminated since the central axis (90) of the vertical roller 92 is always normal to the curved line "$\beta$" which represents the ridges 72' and 70' of the guide track 66'.

FIG. 15 shows the sixth embodiment of the invention, which can also adequately solve the drawback encountered in the first embodiment. In the sixth embodiment, improvement is provided both in the curved portion 106 of the guide track 66'' and in the arrangement of the two horizontal rollers 86' and 88' on the roller supporter 74. As will be well understood hereinlater, the curved sections of the ridges 70'' and 72'' of the guide track 66'' are formed into a circular arc whose radius is "r". As is best seen in FIG. 16, the curved section of the base wall section 66''c is formed to have two, vertically separated track sections 66''c -a and 66''c-b each of which forms a circular arc whose radius is "r". It should be noted that the arc track section 66''c-a starts from the point "$P'_2$" and finishes at the point "$P'_3$" and the other arc track section 66''c-b starts from the point "$P'_1$" and finishes at the point "$P'_4$" as shown in FIG. 15. The horizontal rollers 86' and 88' are respectively connected to right-lower and left-upper positions of the roller supporter 74 so that these rollers 86' and 88' respectively run on the two track sections 66''c-b and 66''c-a, during the sliding movement thereof along the guide track 66''.

Figure 17:
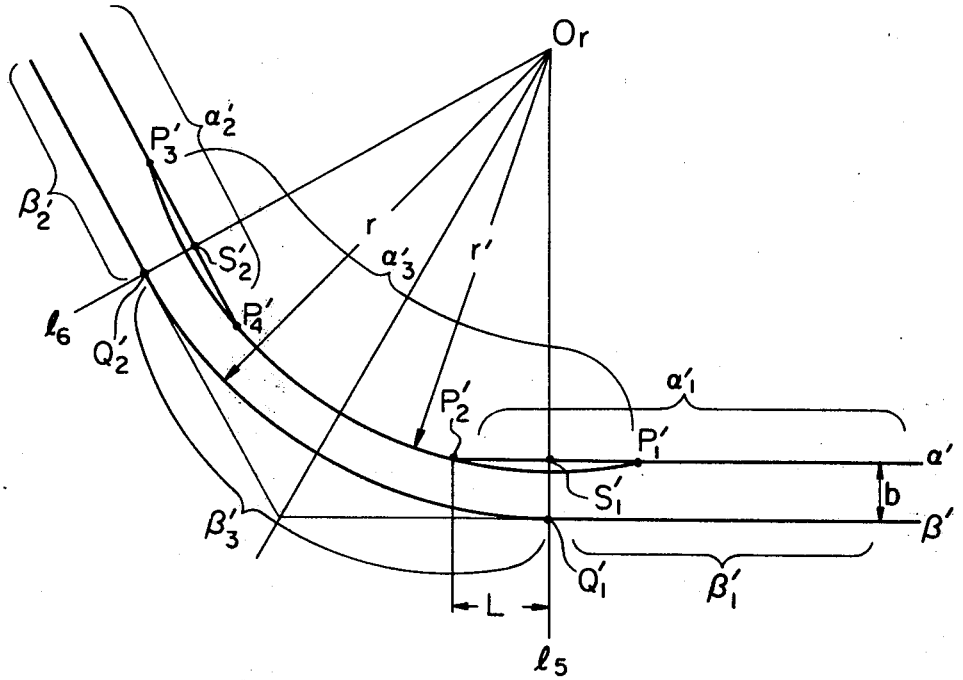
FIG. 17 is a diagrammatic illustration for explaining the method of determining the geometry of the guide track illustrated in FIG. 15.

FIG. 17 is a diagrammatic illustration for showing the method of determining the above-mentioned curved portion 106 of the guide track 66''. In the drawing, the references "$\alpha'''$" and "$\beta'''$" denote respective lines which are defined by the base wall section 66''c and each ridge 72 (or 70) of the guide track 66''. Further, the references "b" and "L" respectively denote the distance between the straight portions of the base wall section 66''c and the ridge 72 or 70 and the half of the distance between respective vertical shafts 82' and 84' of two horizontal rollers 86' and 88'. The line "$\beta'''$" is formed to consist of two straight sections "$\beta'_1$" and "$\beta'_2$" and a circular arc section "$\beta'_3$" of a radius "r", the center of a circle having the arc section "$\beta'_3$" being denoted by the reference "$O_r$". The line "$\alpha'''$" is formed to have two straight sections "$\alpha'_1$" and "$\alpha'_2$" and a circular arc section "$\alpha'_3$" of radius "r'", as shown.

The line "$\alpha'''$" is determined by the following method:

1. Marking the point where the sections "$\beta'_1$" and "$\beta'_3$" intersect, with "$Q'_1$", and drawing a straight line "$l_5$" which passes through the points "$Q'_1$" and "$O_r$".

2. Marking the point on the line "$l_5$" spaced inwardly from the point "$Q'_1$" by the distance "b", with "$S'_1$".

3. Drawing a straight line "$\alpha'_1$" which passes through the point "$S'_1$" so as to be parallel with the straight line "$\beta'_1$".

4. Marking the points on the line "$\alpha'_1$" spaced apart from the point "$S'_1$" in both directions by the distance "L", with "$P'_1$" and "$P'_2$", as shown.

5. Marking the point where the sections "$\beta'_2$" and "$\beta'_3$" intersect, with "$Q'_2$", and drawing a straight line "$l_6$" which passes through the points "$Q'_2$" and "$O_r$".

6. Marking the point on the line "$l_6$" spaced inwardly apart from the point "$Q'_2$" by the distance "b", with "$S'_2$".

7. Drawing a straight line "$\alpha'_2$" which passes through the points "$S'_2$" so as to be parallel with the straight line "$\beta'_2$".

8. Marking the points on the line "$\alpha'_2$" spaced apart from the point "$S'_2$" in both directions by the distance "L", with "$P'_3$" and "$P'_4$", as shown.

9. Drawing an arc "$\alpha'_3$" from the point "$P'_3$" to the point "$P'_1$" so that the arc is a part of a circle having the center at the point "$O_r$". It should be noted that the arc drawn passes through the points "$P'_4$" and "$P'_2$". ("r'" represents the radius of the circle passing through the points "$P'_1$", "$P'_2$", "$P'_3$" and "$P'_4$".)

Now, it should be noted that the following equation will hold for "r'", "r", "b" and "L" if the radius of each horizontal roller 86' or 88' is assumed to be zero.

$$r'=\sqrt{(r-b)^2+L^2} \quad (3)$$

As has been mentioned before, the arc section formed between the points "$P'_1$" and "$P'_4$" defines the curved track for the horizontal roller 86' and the arc section between the points "$P'_2$" and "$P'_3$" defines the curved section for the roller 88'.

By determining the curved portion of the guide track 66'' in the above-mentioned manner, the before-mentioned drawback encountered in the first embodiment will be completely eliminated since the central axis (90)

of the vertical roller 92 is always maintaned normal to the curved line "α'" which represents the two track sections 66"*c–c* and 66"*c–b* of the base wall section 66"*c* of the guide track 66".

With the above-stated construction of the sliding mechanism according to the present invention, the following several merits and advantages will be obtained:

1. Since the horizontal rollers 86 (86') and 88 (88') are assuredly guided by only rolling on the base wall section 66*c*, 66'*c* or 66"*c* of the guide track 66, 66' or 66" which is compactly received in the horizontal groove 68 of the side wall 14 of the vehicle, it is unnecessary to provide the guide track with a channel construction constructed to receive therein the horizontal rollers. Thus, the body styling is not interfered and the appearance of the vehicle is not marred.

2. It becomes possible to use relatively large rollers for the horizontal rollers 86 (86') and 88 (88') because of absence of the channel construction. This means that the rate of abrasion of the rollers is quite low thus assuring a long life.

3. Since the arrangement between the horizontal rollers and the vertical roller can be changed without changing the form of the guide track, such type sliding mechanism can be widely used.

4. In a case that the horizontal rollers are arranged to roll on the outer surface of the side wall 14 of the vehicle, the sliding mechanism can be more compactly constructed.

5. If the sliding mechanism is constructed as explained in the fifth and sixth embodiments, the rolling movements of the horizontal rollers and the vertical roller and thus the door to which the rollers are fixed are more smoothly and reliably carried out, especially at the curved portion of the guide track.

6. The vertical roller does not undergo sideway slippage even under running along the curved portion of the guide track.

7. If the sliding mechanism is constructed as shown in FIG. 9, the vertical roller 92 is never derailed from the guide track 66 even after marked abrasion of the vertical roller 72 occurs.

What is claimed is:

1. A sliding mechanism for a sliding door which is slidable forwardly and rearwardly along a side wall of a vehicle to selectively close and open an opening formed in said side wall, said sliding mechanism comprising:

first guide track means attached to said side wall of said vehicle so as to be substantially horizontal with respect to the chassis of said vehicle and curved at a position near said opening toward the inside of said vehicle, said first guide track means being formed with an elongate ridge portion which projects upwardly and longitudinally extends throughout said first guide track means;

second guide track means attached to the side wall of said vehicle at a position near said first guide track so as to be substantially horizontal with respect to the chassis of said vehicle and parallel to said first guide track means, said second guide track means being formed with a vertical surfce which extends parallelly to said elongate ridge portion;

a support member pivotally connected to an end of said door;

at least one vertical roller rotatably connected to said support member in such a manner that an axis of said vertical roller is substantially horizontal with respect to the chassis of said vehicle when said support member takes a postion with a predetermined angle with respect to the inside surface of said door, said vertical roller being formed at its peripheral wall section with an annular groove; and at least one horizontal roller rotatably connected to said support member in such a manner that an axis of said horizontal roller is substantially perpendicular with respect to said chassis, the axes of said vertical and horizontal rollers being perpendicular with each other, the assemblage of said door with the side wall of said vehicle being such that said vertical roller rolls on said elongate ridge of said first guide track means receiving in the annular groove thereof said ridge portion and said horizontal roller rollably contacts at its cylindrical outer surface with said vertical surface of said second guide track means, the distance between said ridge portion of said first guide track means and the vertical surface of said second guide track means at a position where said ridge portion and said vertical surface are curved toward the inside of said vehicle being smaller than the distance between same along non-curved portions so that the axis of said vertical roller is always perpendicular to said ridge portion of said first guide track means irrespective of positions of said door with respect to the side wall of said vehicle.

2. A sliding mechanism as claimed in claim 1, in which said first and second guide track means are integrated to form a mono-construction.

3. A sliding mechanism as claimed in claim 1 in which said first and second guide track means are received in a horizontally extending groove formed in said side wall of said vehicle.

4. A sliding mechanism as claimed in claim 1, in which said first guide track means is formed with another elongate ridge portion which projects downwardly and longitudinally extends throughout said first guide track means so a to be received in said annular groove of said vertical roller.

5. A sliding mechanism as claimed in claim 4, in which said first and second guide track means are integrated to form a channel construction having a generally C-shaped cross section, said channel construction having a pair of side wall sections which respectively have said ridge portions projecting toward each other and a base wall section which has said vertical surface, said channel construction being substantially arranged on said side wall of said vehicle in a manner that said pair of side wall sections of said construction extend outwardly and laterally from said vehicle.

6. A sliding mechanism as claimed in claim 3, in which said pair of said wall sections of said channel construction are formed at their leading ends with respective flanges which extend close to each other to form therebetween a clearance the width of which is considerably smaller than the diameter of said vertical roller.

7. A sliding mechanism as claimed in claim 1, further comprising biasing means which biases said support member to swing in a direction to engage said horizontal roller with the vertical surface of said second guide track means.

8. A sliding mechanism as claimed in claim 5, in which said biasing means is a spring having multiple turns.

9. A sliding mechanism for a sliding door which is slidable forwardly and rearwardly along a side wall of a vehicle to selectively close and open an opening formed in said wall, said sliding mechanism comprising:

first guide track means attached to said side wall of said vehicle so as to be substantially horizontal with respect to the chassis of said vehicle and curved at a position near said opening toward the inside of said vehicle, said first guide track means being formed with an elongate ridge portion which projects upwardly and longitudinally extends throughout said first guide track means;

second guide track means attached to the side wall of said vehicle at a position near said first guide track so as to be substantially horizontal with respect to the chassis of said vehicle and parallel to said first guide track means, said second guide track means being formed with a vertical surface which extends parallelly to said elongate ridge portion;

a support member pivotally connected to an end of said door at least one vertical roller rotatably connected to said support member in such a manner that an axis of said vertical roller is substantially horizontal with respect to the chassis of said vehicle when said support member takes a position with a predetermined angle with respect to the inside surface of said door, said vertical roller being formed at its peripheral wall section with an annular groove; and two horizontal rollers rotatably connected to said support member in such a manner that axes of said horizontal rollers are substantially perpendicular with respect to said chassis and thus perpendicular to the axis of said vertical roller, said horizontal rollers being arranged to put said vertical roller therebetween, the outer cylindrical surfaces of said two horizontal rollers being in rollable contact with the vertical surface of said second guide track means upon forward and rearward movements of said door, the assemblage of said door with the side wall of said vehicle being such that said vertical roller rolls on said elongate ridge of said first guide track means receiving in the annular groove thereof said ridge portion and said horizontal rollers contact at their cylindrical outer surfaces with said vertical surface of said second guide track means, said vertical surface of said second guide track means being formed at the curved portion with vertically separated two track sections which are different in shape from each other, said two horizontal rollers being arranged to be vertically separated from each other so as to respectively and rollably contact with said two track sections during the movements of said two horizontal rollers along the curved portion of said first guide track means.

* * * * *